US007029139B2

(12) United States Patent
McCarthy, III

(10) Patent No.: US 7,029,139 B2
(45) Date of Patent: Apr. 18, 2006

(54) LIGHTING FIXTURE WITH WATER SHUNT

(75) Inventor: Charles A. McCarthy, III, Gurnee, IL (US)

(73) Assignee: Kenall Manufacturing Company, Gurnee, IL (US)

( * ) Notice: Subject to any disclaimer, the term of this patent is extended or adjusted under 35 U.S.C. 154(b) by 0 days.

(21) Appl. No.: 10/839,427

(22) Filed: May 5, 2004

(65) Prior Publication Data

US 2005/0248948 A1 Nov. 10, 2005

(51) Int. Cl.

| | |
|---|---|
| ***F21V 33/00*** | (2006.01) |
| ***F21V 15/00*** | (2006.01) |
| ***F21S 8/00*** | (2006.01) |
| ***H01R 33/00*** | (2006.01) |

(52) U.S. Cl. ..... 362/101; 362/96; 362/149; 362/362; 362/645

(58) Field of Classification Search ..... 362/362; D26/118

See application file for complete search history.

(56) References Cited

U.S. PATENT DOCUMENTS

| | | | | |
|---|---|---|---|---|
| D148,695 | S * | 2/1948 | Guth et al. | D26/76 |
| 4,282,564 | A * | 8/1981 | McJunkin, Jr. et al. | 362/217 |
| 5,278,738 | A * | 1/1994 | Illes | 362/147 |
| 5,452,188 | A * | 9/1995 | Green et al. | 362/493 |
| 6,352,358 | B1 * | 3/2002 | Lieberman et al. | 362/294 |
| 2003/0048632 | A1 * | 3/2003 | Archer | 362/101 |

* cited by examiner

*Primary Examiner*—Renee Luebke
*Assistant Examiner*—David Makiya
(74) *Attorney, Agent, or Firm*—Jansson, Shupe, Munger & Antaramian, Ltd.

(57) ABSTRACT

A lighting fixture includes a lens frame having a rearmost rear-facing side with an outer perimeter, a baseplate connected to the lens frame, and a water shunt provided at the rearmost rear-facing side near the outer perimeter of the lens frame, the water shunt being structured for restricting water flow directed inwardly of the outer perimeter of the lens frame. A method includes providing a lens frame having a rearmost rear-facing side with an outer perimeter, providing a baseplate connected to the lens frame, and providing a water shunt provided at the rearmost rear-facing side near the outer perimeter of the lens frame, the water shunt being structured for restricting water flow directed inwardly of the outer perimeter of the lens frame.

26 Claims, 10 Drawing Sheets

FIG. 4A
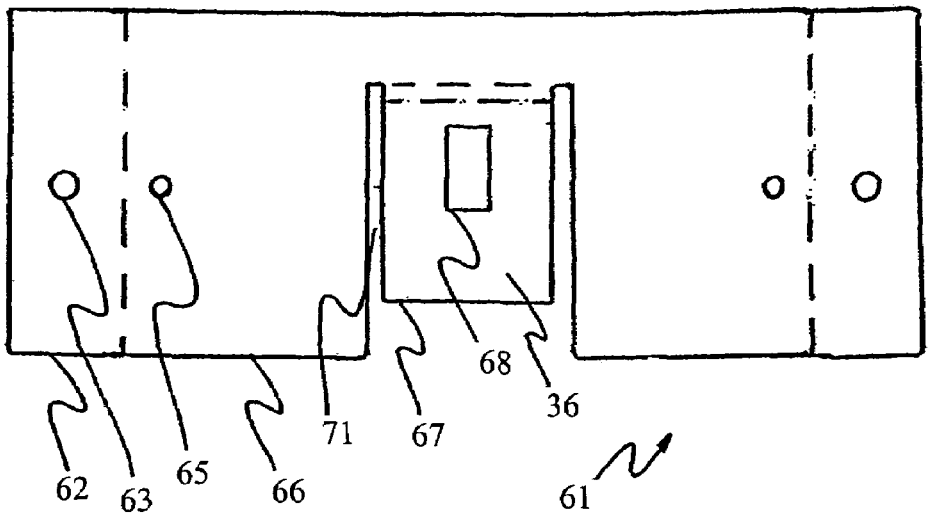
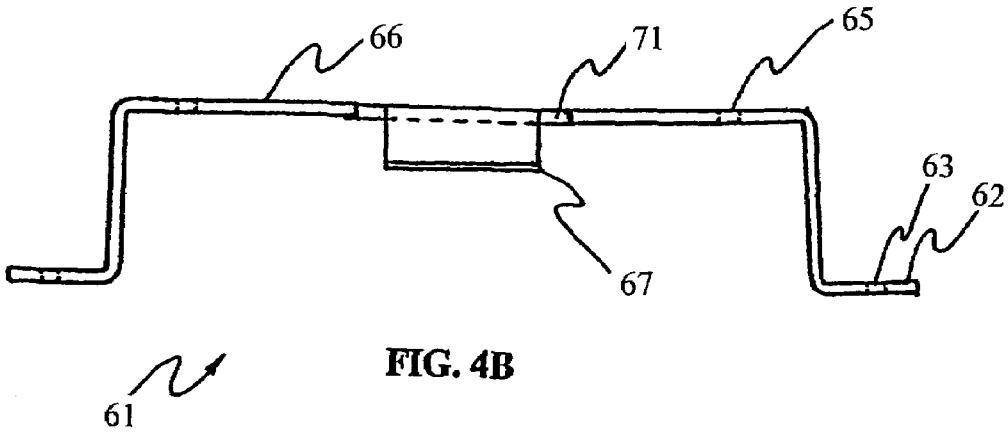
FIG. 4B

LIGHTING FIXTURE WITH WATER SHUNT

RELATED APPLICATIONS

The invention is related to U.S. application Ser. No. 10/839,428, entitled "Sconce-Type Lighting Fixture," incorporated herein by reference in its entirety.

BACKGROUND

1. Field of the Invention

The invention relates generally to lighting fixtures and, more particularly, to a lighting fixture having improved durability and adapted for scalable and modular construction thereof.

2. Background of the Invention

The architectural community uses indoor and outdoor lighting products to enhance the image of their facilities, both during the daytime and at night. Of course, tastes may differ, and lighting fixtures may also be selected with little regard for appearance. In either case, a high abuse lighting environment may exist in a commercial facility, where lighting fixtures are subjected to a higher possibility of events and/or conditions that could cause physical and/or environmental damage to the lighting fixture.

Wall fixtures may includes sconces adapted for creating various lighting effects, for example, indirect or accent lighting, direct lighting such as by using luminaires and reflectors, for illuminating walls, walkways, hallways, common areas and the like, for achieving a degree of softness of a lighting environment, for directing illumination in a vertical and/or horizontal direction, for incorporating a particular type of lamp, and others. Wall sconces may be designed to present an aesthetically pleasing overall appearance.

Conventional sconce-type lighting fixtures may provide abundant options regarding aesthetic designs for indoor or outdoor applications. However, such aesthetically designed fixtures do not provide an acceptable environmental durability necessary for public areas. For example, conventional sconce-type lighting fixtures do not address a water-ingress problem, such as that occurring from a high-volume sheet of water falling down a wall surface or a small-volume trickle. In addition, conventional sconce-type lighting fixtures are not designed to provide scalability, modularity, and easy assembly and installation.

OBJECTS OF THE INVENTION

It is an object of the invention to provide improved sconce-type lighting fixtures for overcoming some of the problems and shortcomings of the prior art, including those referred to above.

Another object of the invention is to provide aesthetically pleasing sconce-type lighting fixtures resistant to breakage such as that caused by vandalism or accidental impact from a foreign object and resistant to damage caused by their environment.

Another object of the invention is to provide sconce-type lighting fixtures for illuminating potentially hazardous areas.

Still another object of the invention is to provide sconce-type lighting fixtures that provide both water resistance and serviceability.

Yet another object of the invention is to provide a scalable and modular design for sconce-type lighting fixtures.

Another object of the invention is to provide a sconce-type lighting fixture resistant to corrosion.

A further object of the invention is to provide a sconce-type lighting fixture that may be easily assembled and installed.

How these and other objects are accomplished will become apparent from the following descriptions and drawing figures.

SUMMARY

According to an aspect of the invention, a lighting fixture includes a lens frame having a rearmost rear-facing side with an outer perimeter, a baseplate connected to the lens frame, and a water shunt provided at the rearmost rear-facing side near the outer perimeter of the lens frame, the water shunt being structured for restricting water flow directed inwardly of the outer perimeter of the lens frame.

According to another aspect of the invention, a method includes providing a lens frame having a rearmost rear-facing side with an outer perimeter, providing a baseplate connected to the lens frame, and providing a water shunt provided at the rearmost rear-facing side near the outer perimeter of the lens frame, the water shunt being structured for restricting water flow directed inwardly of the outer perimeter of the lens frame.

According to a still further aspect of the invention, in a lighting fixture having a baseplate connected to a lens frame having a rearmost rear-facing side with an outer perimeter, an improvement includes a water shunt provided at the rearmost rear-facing side near the outer perimeter, the water shunt being structured for restricting water flow directed inwardly of the outer perimeter of the lens frame.

The invention provides a lighting design methodology that combines aesthetics, ease of manufacturing, modularity, scalability, water resistance and channeling, safety, illuminating potentially hazardous areas, resistance to breakage and corrosion, resistance to litter, serviceability, adaptability, and other considerations. These practical considerations provide an improved sconce-type lighting fixture, and associated methods.

This summary does not limit the invention, which is instead defined by the appended claims.

BRIEF DESCRIPTION OF THE DRAWING FIGURES

FIG. 1 is a front view of a sconce-type lighting fixture according to an exemplary embodiment of the present invention.

FIGS. 4A and 4B respectively show a top view and a side view of a light socket mounting bracket according to an exemplary embodiment of the present invention.

Figure 5:
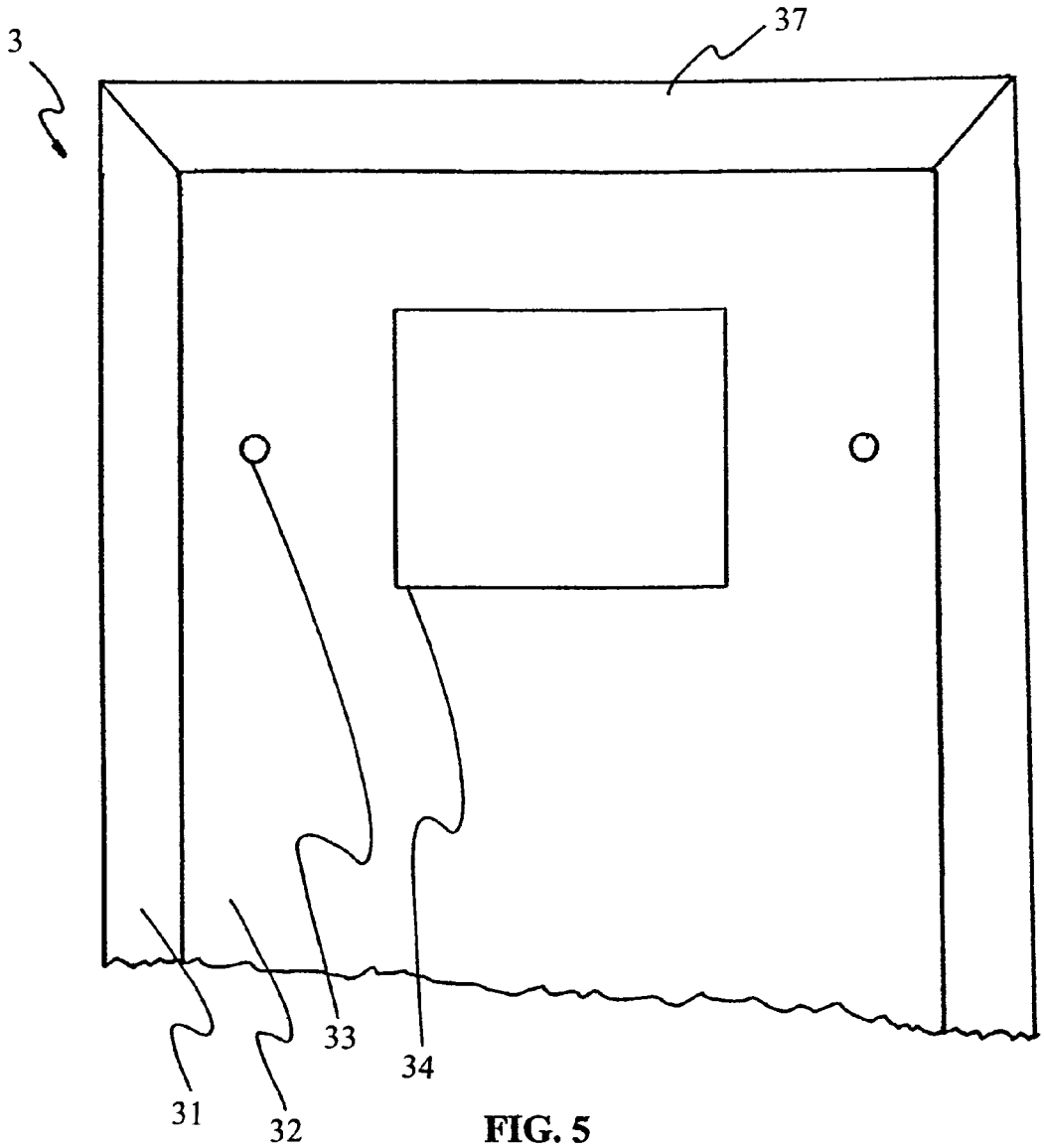

FIG. 5 shows a partial top view of a reflector portion of a sconce-type lighting fixture according to an exemplary embodiment of the present invention.

Figure 6:
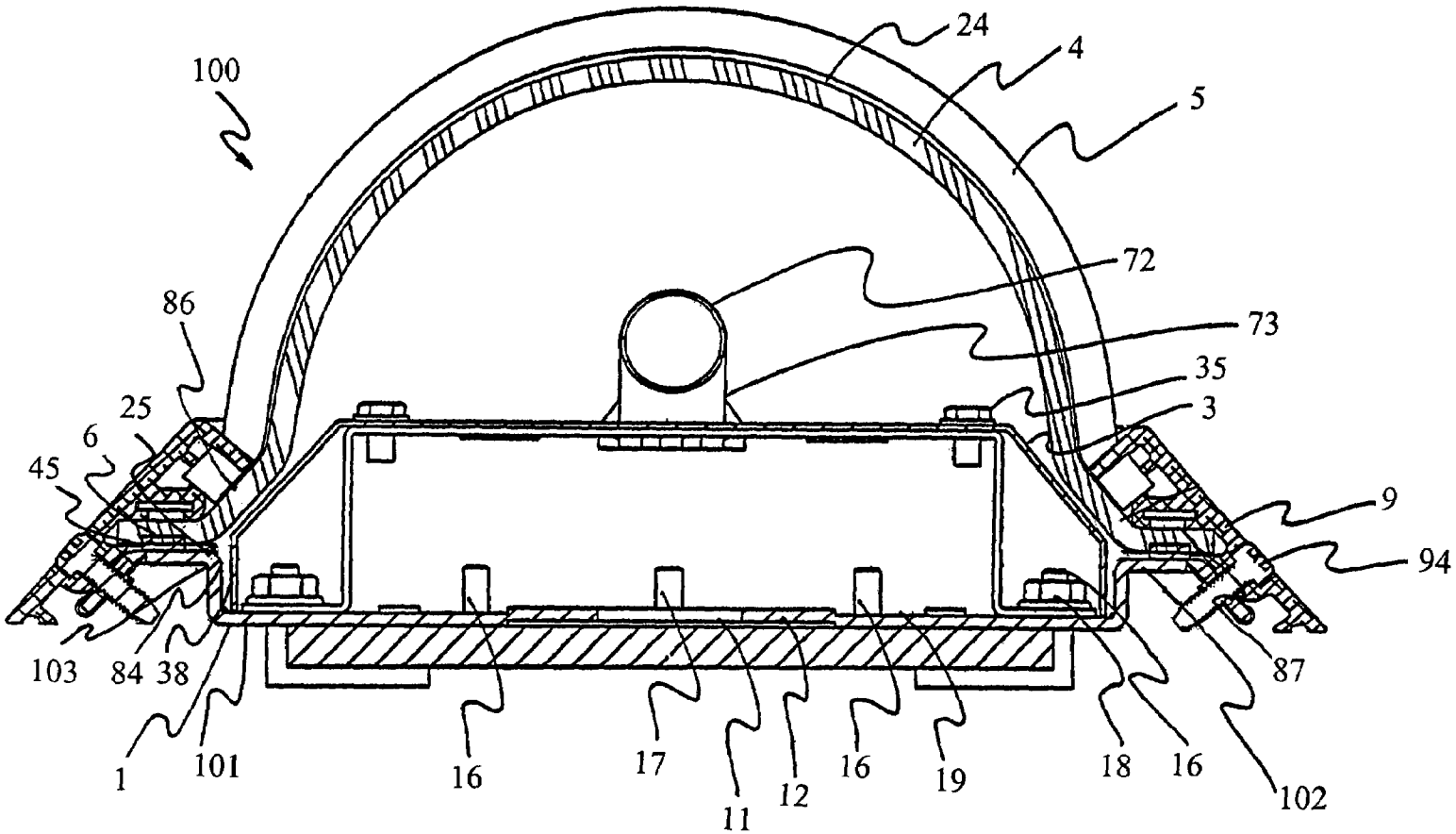

FIG. 6 is a cross sectional end view of a sconce-type lighting fixture according to an exemplary embodiment of the present invention.

Figure 7:
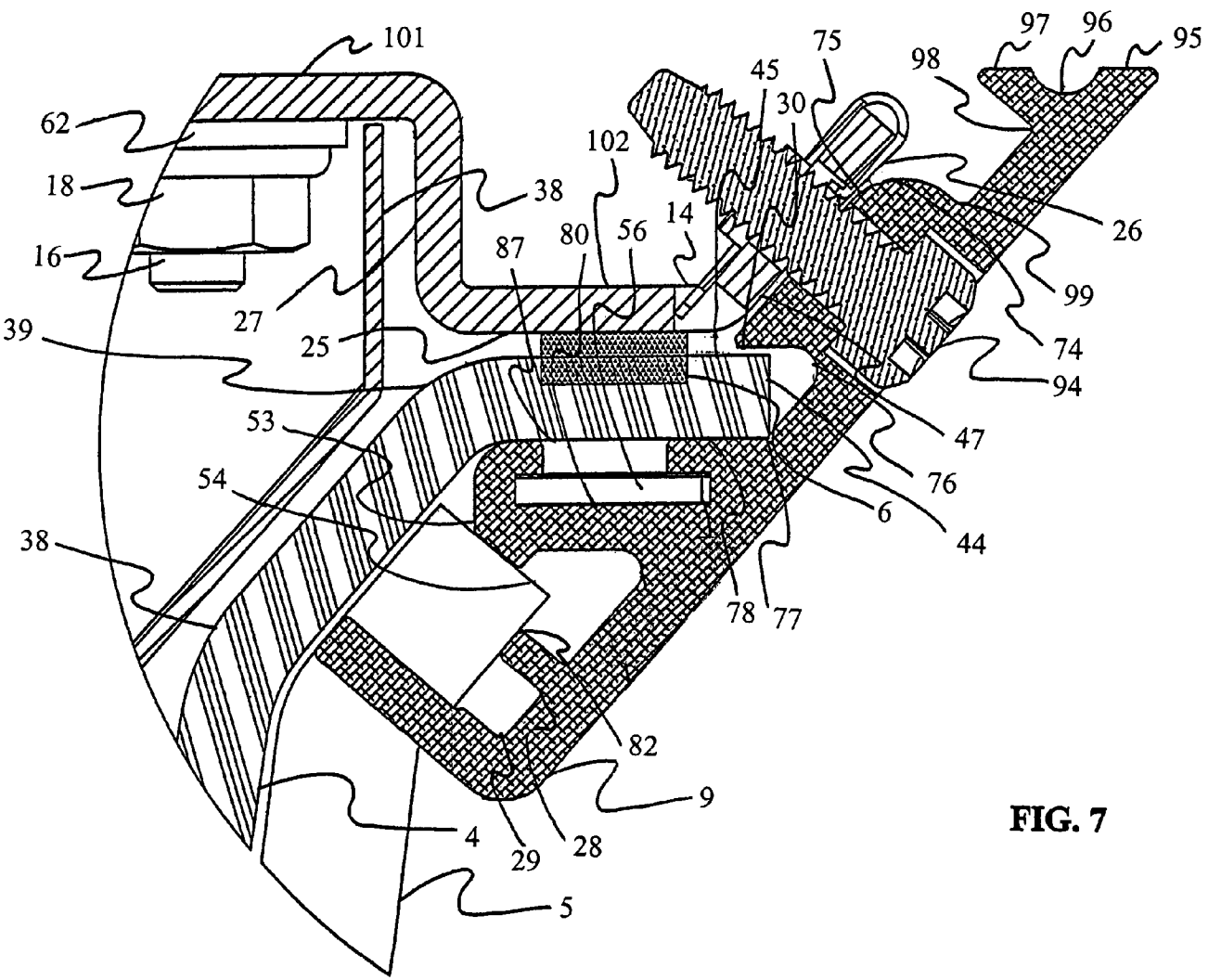

FIG. 7 is an enlarged view of a section of FIG. 6.

Figure 8:
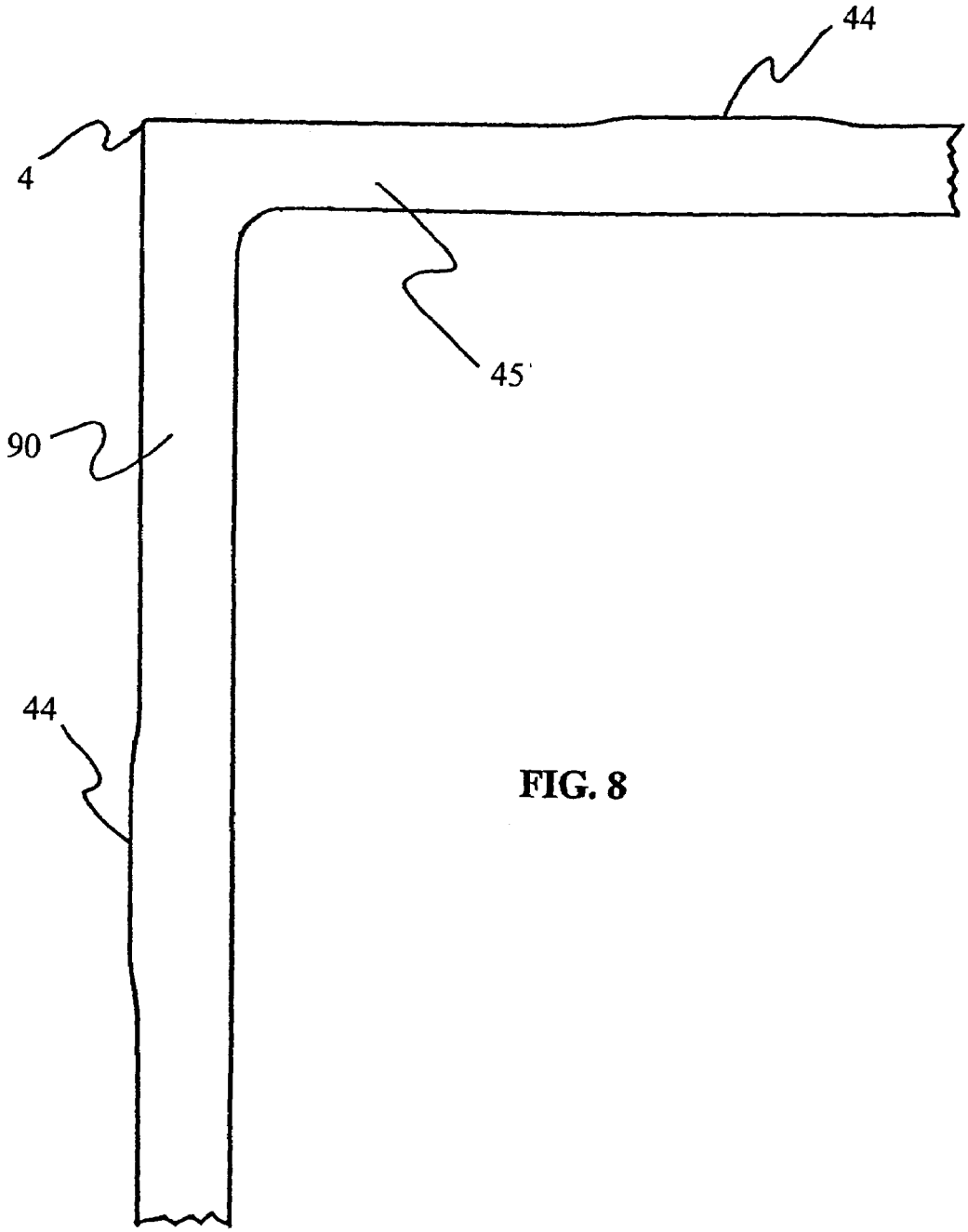

FIG. 8 is a partial top view of a footprint of a lens used in a sconce-type lighting fixture according to an exemplary embodiment of the present invention.

Figure 9:
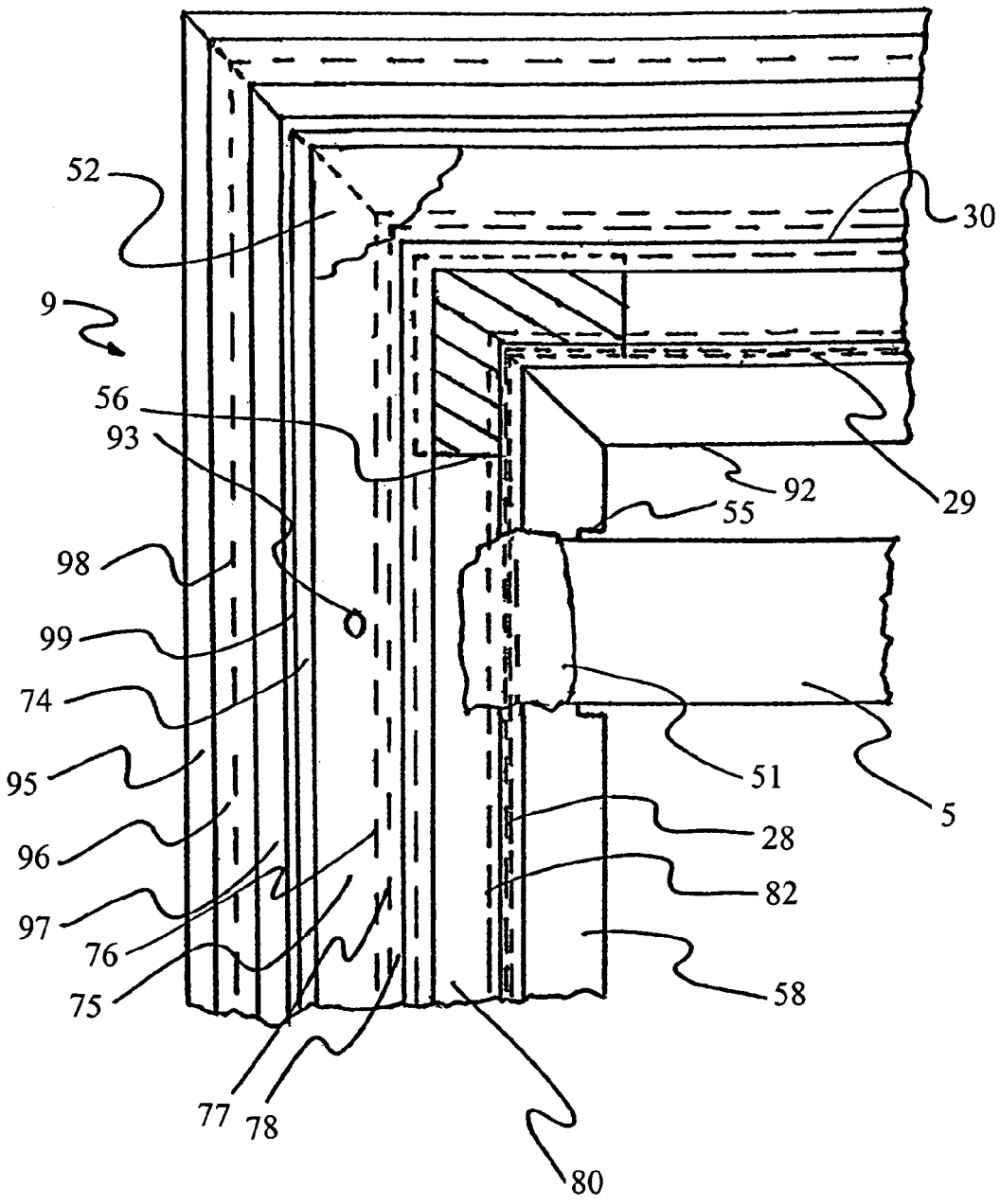
Figure 10A:
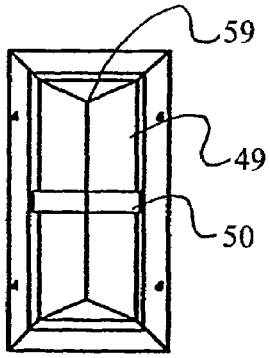
Figure 10B:
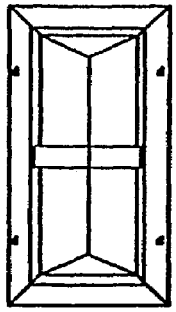
Figure 10C:
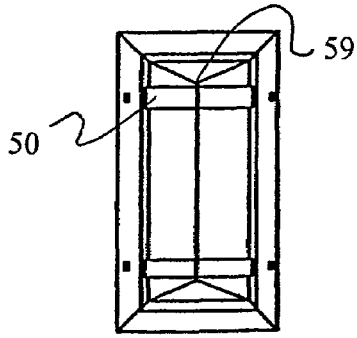
Figure 10D:
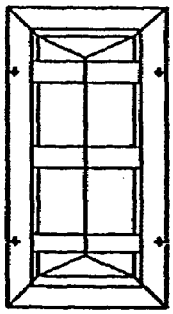
Figure 10E:
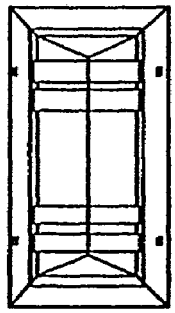
Figures 11A, 11B, 11C, 11D:
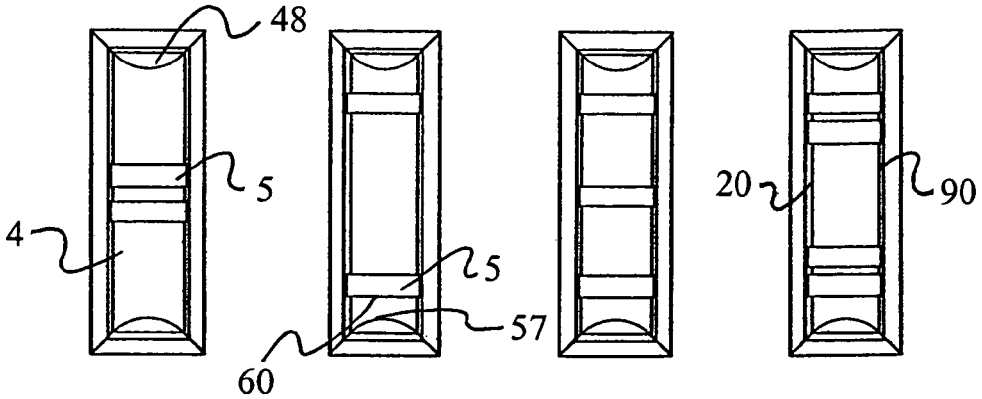

FIG. 9 is a partial rear view of a lens frame used in a sconce-type lighting fixture according to an exemplary embodiment of the present invention.

FIGS. 10A–10E show various configurations for one or more rigid horizontal bars in a sconce-type lighting fixture according to exemplary "roof" type embodiments of the present invention.

FIGS. 11A–11D show various configurations for one or more rigid horizontal bars in a sconce-type lighting fixture according to exemplary "dome" type embodiments of the present invention.

Figure 12:
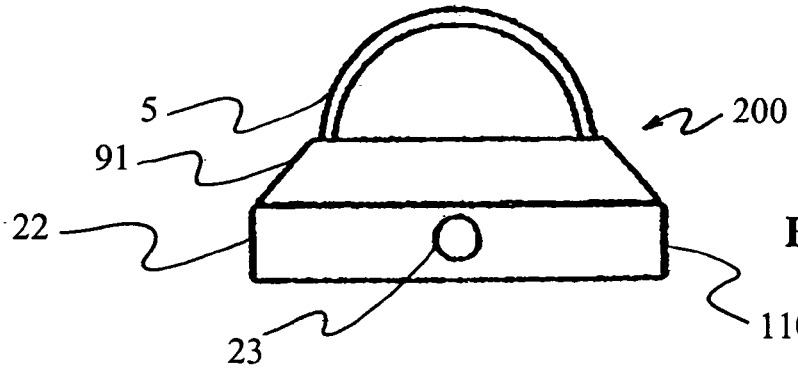

FIG. 12 is an end view of a sconce-type lighting fixture having a deep housing surface adapter according to an exemplary embodiment of the present invention.

Figure 13A:
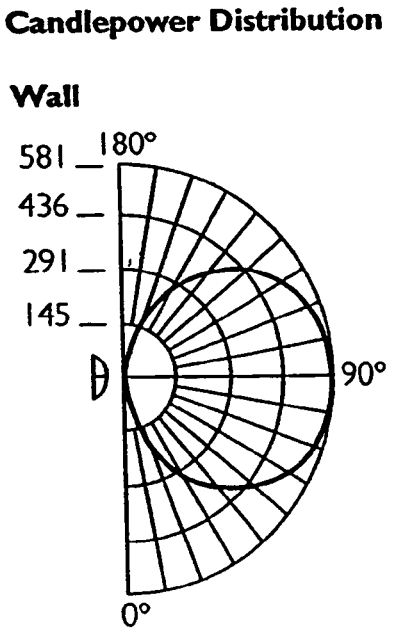
Figure 13B:
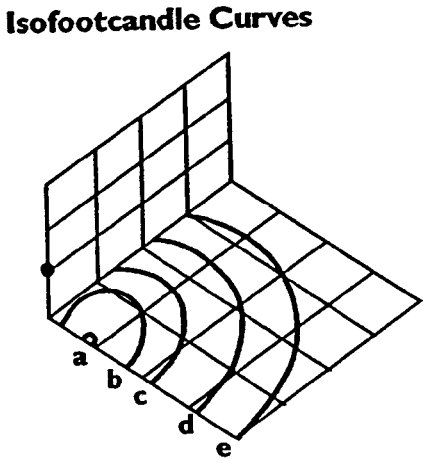

FIGS. 13A and 13B show photometric information for a sconce-type lighting fixture according to an exemplary embodiment of the present invention.

DETAILED DESCRIPTION OF PREFERRED EMBODIMENTS

FIG. 1 is a front view of a sconce-type lighting fixture 10 according to an exemplary embodiment of the present invention. A lens 49 extends outwardly from a lens frame 9. Crossbars 50 are welded to lens frame 9 and protectively cover a portion of the outside surface of lens 49. Lens frame 9 has beveled portions 91, 92 that provide two uniformly angled surfaces facing out to the front of lighting fixture 10. Four mounting holes 93 are provided in lens frame 9 for accepting fasteners 8 that secure lens frame 9 to a rear portion of lighting fixture 10. The lens 49 shown in FIG. 1 is a "roof" type diffuser externally having two symmetric and adjoining side walls 41, and two symmetrically slanted end walls 42. As described further below, the profile of crossbars 50 'follows' the shape of lens 49 to minimize any gap therebetween. This allows crossbars 50 to provide optimal protection while also providing an aesthetically pleasing appearance. Similarly, other shapes may be utilized for a lens and corresponding crossbars, where such crossbars follow the shape of the particular lens.

The various component parts of lighting fixture 10 are designed with the intent that such components, and corresponding manufacturing systems, may be used for as many different embodiments as possible. For example, for a given width of lighting fixture 10, crossbars 5 and lens frame end pieces 89 may be used for a lighting fixture model having any length. Similarly, stock and tooling such as molds and jigs used in forming lens 4 and lens frame 9 may be simply adapted to a desired length fixture.

Figure 2:
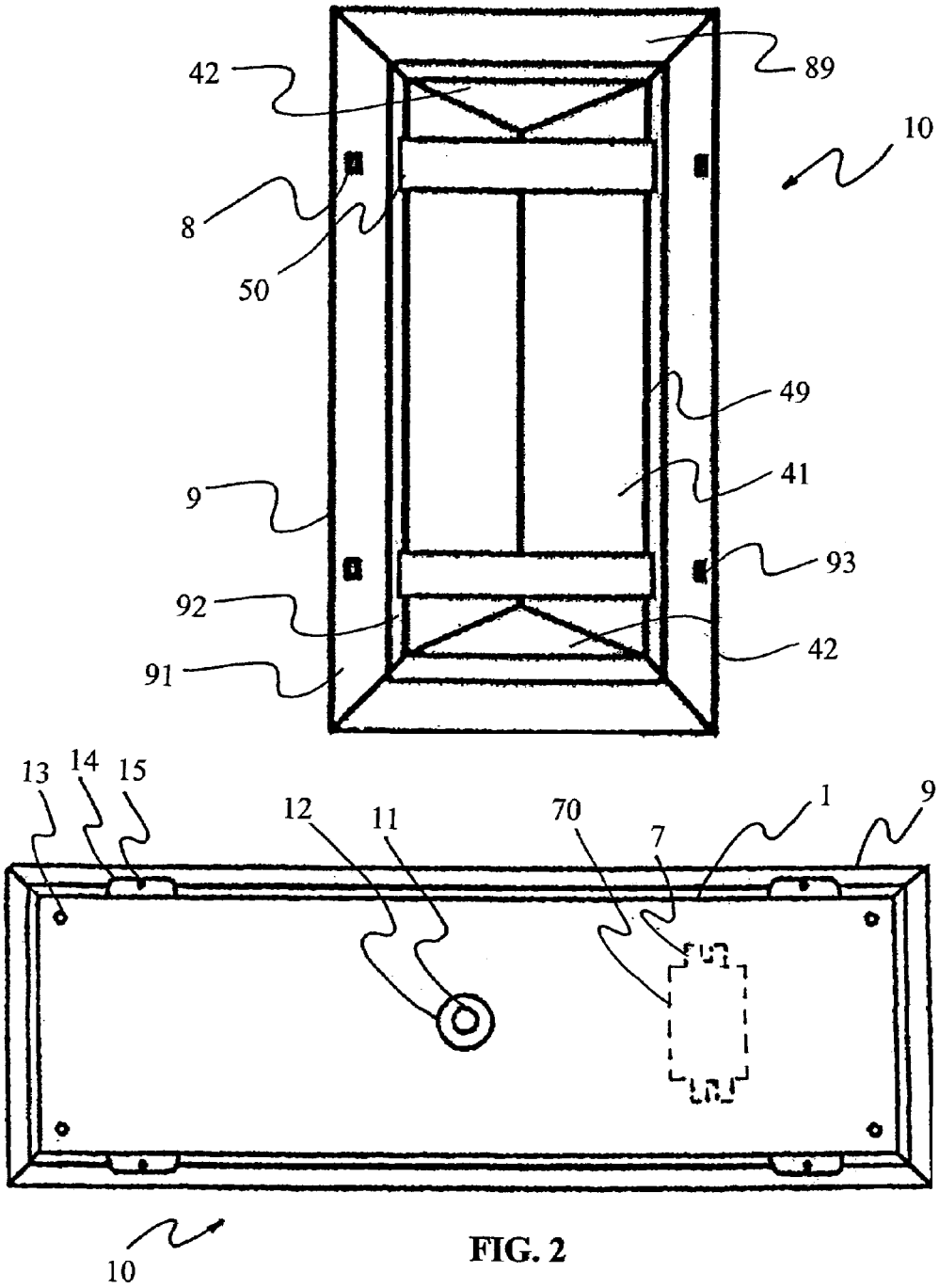
FIG. 2 is a rear view of a sconce-type lighting fixture according to an exemplary embodiment of the present invention.

FIG. 2 is a rear view of a sconce-type lighting fixture 10 according to an exemplary embodiment of the present invention. A baseplate 1 may have mounting holes 13 for securely attaching baseplate 1 to a wall or other mounting surface, preferably using watertight attachment devices, such as masonry screws and plastic inserts with sealing adhesives or surfaces. A center hole 11 is provided in baseplate 1 for attachment of a conduit fitting or other apparatus for feeding wires to lighting fixture 10 from an electric supply such as an AC line. A knockout 12 may be provided in baseplate 1 so that an installer may use a larger size conduit or other fitting by removing the knockout in a known manner. Baseplate 1 has four extensions 14 that each have holes 15. Holes 15 are placed so that they are respectively aligned with holes 93 of lens frame 9 when assembling light fixture 10. Fasteners 8 may be securely attached to baseplate 1 via holes 93, 15, thereby securing lens frame 9 to baseplate 1.

Figure 3:
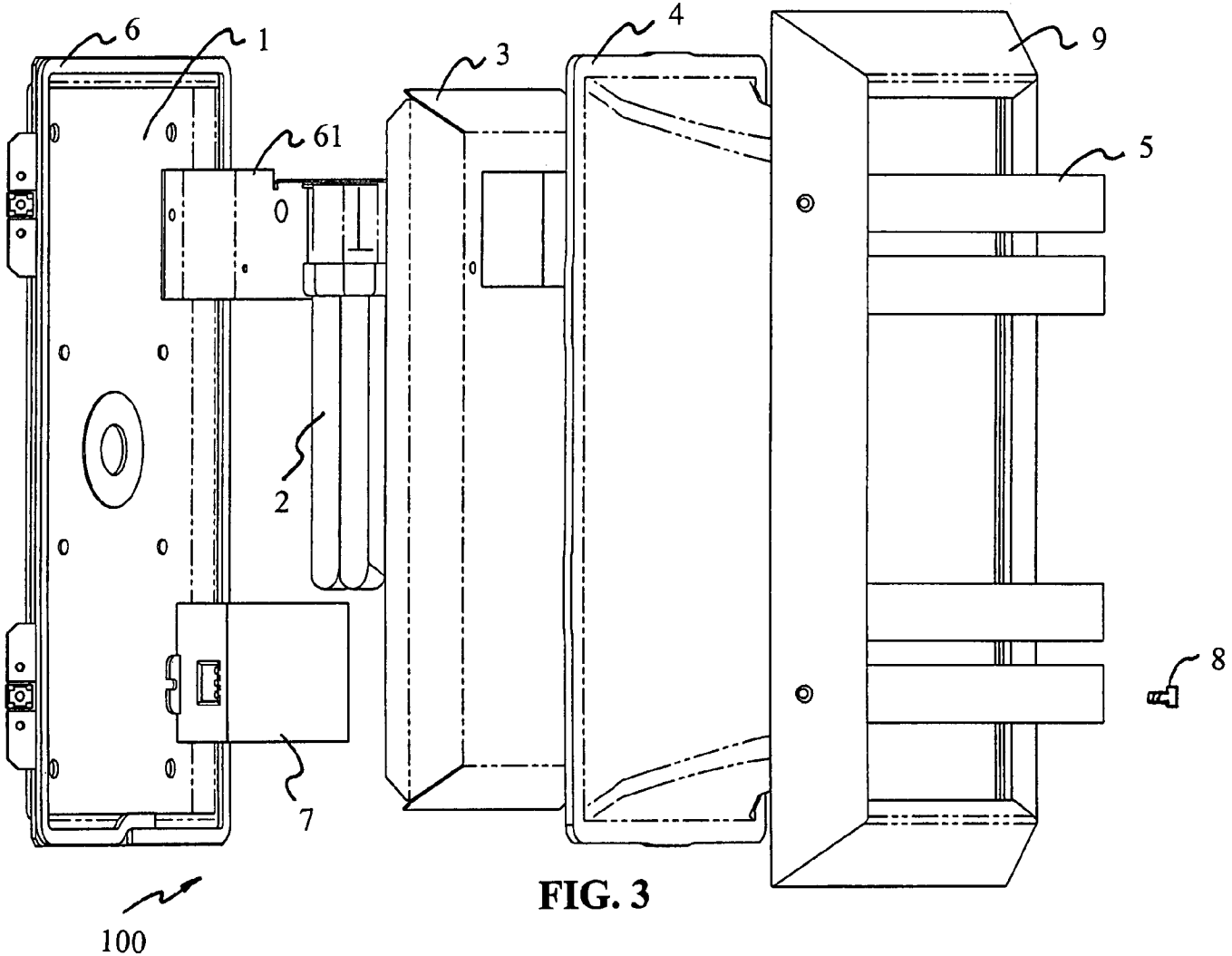
FIG. 3 is an exploded view of a sconce-type lighting fixture according to an exemplary embodiment of the present invention.

FIGS. 3–9 show a sconce-type lighting fixture 100 according to an exemplary embodiment of the present invention. FIG. 3 is an exploded view of lighting fixture 100. Baseplate 1 is preferably die formed using marine grade aluminum. Baseplate 1 is free of any unused openings, and all seams are TIG welded, thereby providing a solid, sealed, corrosion-resistant mounting base for securing lighting fixture 100 to a wall or other mounting location. Baseplate 1 has four mounting holes 13 respectively located near the baseplate corners for four-point mounting of fixture 100 such as by using insert type screw assemblies, weatherproof bolt assemblies, and others. Center hole 11 may be provided in the center portion of baseplate 1 for attachment of a conduit fitting or similar type of wire feed apparatus. For example, when used for indoor lighting, a strain relief may be used in center hole 11 for securely attaching a power cord, or a grommet or sleeve may be used for feeding an AC line through a corresponding hole in an attachment surface such as a wall. Knockout 12 may be provided around center hole 11, for over box mounting and/or attachment of large fittings (e.g., two-inch). For external use, an appropriate UL and NEMA approved fitting is used for inputting AC power when mounting lighting fixture 100 in corrosive and/or wet locations such as outdoors.

Threaded studs 16 are provided for attachment of various items to a bottom portion 19 of baseplate 1 by use of nuts 18. Lockwashers (not shown) and similar hardware may also be used. Pairs of the threaded studs 16 are provided for mounting one or more ballast assemblies 7 (when applicable) and a lamp socket assembly 61. A single threaded stud 17 may be provided as a grounding post for electrically connecting an input ground wire to baseplate 1 and, thereby, to all the metal of lighting fixture 100 conductively connected to baseplate 1. Bottom portion 19 is recessed from a flat edge surface 25 formed around the outer periphery of baseplate 1, with one or more surfaces 27, either vertical or beveled, therebetween. Two extensions 14 are located on each lengthwise side of baseplate 1 and extend outside the rectangular frame portion of baseplate 1. Clip nuts 26 are provided for fitting over respective holes 15 in extensions 14 so that lens frame 9 may be secured to the baseplate 1 by being fastened to the extensions 14 using threaded fasteners 8, which, for example, may be stainless steel tamper-resistant TORX™ or POSIGRIP™ fasteners, and the like, that help prevent unauthorized fixture entry. Alternatively, holes 15 may be threaded holes, or other fastening devices may be used. Extensions 14 are preferably angled away from the rectangular frame portion of baseplate 1, at an angle that allows the attachment surface 47 of extension 14 to be essentially parallel with both the outer surface of beveled portion 91 and inner beveled edge 75 of lens frame 9.

At least one ballast assembly 7 (when applicable) may be mounted on bottom portion 19 of baseplate 1 by being secured to threaded studs 16. Ballast assembly 7 includes a ballast 70 that provides an appropriate voltage, starting circuit (if applicable), and corresponding power capability for a given lamp 2. Ballast assembly 7 is typically not installed for lighting fixtures 100 having lamp(s) not requiring a ballast or starting circuit. A functionality of a ballast 70 can include many different options including, but not limited to, filtering, current and/or voltage regulation, power factor control, remote control and monitoring, brightness adjustment, automatic blackout recovery and similar 'smart' starting circuit functionality, microprocessor-based functions, and others. Ballast 70 is preferably an electronic type ballast having a low profile and weight. According to its functionality, ballast 70 may have extra wires for input (e.g., control)

and output (e.g., functional implementation) circuits, in addition to wires corresponding to AC line input and one or more lamp output voltages.

Depending on the type of ballast 70 used (if any), various connectors may include those located on a side wall of ballast assembly 7 and adapted for electrically connecting, directly or indirectly, to electrical wires from an external power source such as an AC line from a circuit breaker. For example, such wires may be fed through center hole 11 of baseplate 1 and connected to ballast 70 by being attached to pigtail jumper wires of a jumper (not shown) having a male connector mated with a corresponding female connector located on ballast assembly 7. Such a connection may be made using standard twist on wire connectors or similar devices. Alternatively, a ballast connector may have terminals (not shown) for directly or indirectly attaching the electrical wires, for example by use of a split bolt, screw terminal, insertion terminal, spade or other crimp type terminal, and others. Such terminals may be used for attaching a jumper assembly that mates, in turn, with a second jumper assembly attached by twist on wire connectors to the AC line input wires. Another type of ballast connector may have female pins for receiving corresponding male pins from the supply side.

Depending on a size and/or capacity of lighting fixture 100, a corresponding number of ballasts 70 may be installed by being secured to baseplate 1. Many lamps, such as fluorescent type, are designed to be powered in groups by individual ballasts so, for example, a six lamp fixture may utilize two ballasts. Ballast assembly 7 includes a ballast frame having holes or cutouts for mounting ballast 70 to baseplate 1 as described above. AC line input wires may be secured by a known manner of strain relief at center hole 11. The neutral and hot AC lines may be attached to the lead wires of a lamp socket 72 using twist on wire connectors, and the ground wire of the AC feed may be attached to grounding post 17.

A lamp socket mounting assembly 61, preferably formed of marine grade aluminum, is secured to threaded mounting studs 16 of baseplate 1. Holes 63 on mounting surfaces 62 are placed over studs 16 and lamp socket mounting assembly 61 is secured thereon by use of kepnuts 18 or similar fasteners. A center portion 67 is formed by cutting two notches and twice bending a tab portion of lamp socket mounting assembly 61, so that a socket mounting surface 36 is substantially parallel to a top surface 66. (In FIGS. 4A and 4B, bends are shown as dashed lines.). An aperture 68 is formed in socket mounting surface 36. A lamp socket 72 may have mounting spring-clips (not shown) that are snugly insertable into aperture 68. For example, a 'mini-fluorescent' type bulb may have a conventional 'screw-in' bulb base or it may be structured for fitting into a specialized socket; either, way, such a lamp and socket may be connected directly to the AC line voltage without requiring a ballast. Wires from lamp socket 72 may be fed through aperture 68. Notches 71 are formed on either side of center portion 67, the notches 71 being adapted for accepting a slidable insert/mounting portion 73 that includes a locking member (not shown) that 'clicks' into aperture 68 for securely holding the slidable insert 73. Insert 73 includes one or more lamp sockets 72 that have wires extending therefrom at a location designed for optimal placement of the wires connecting to a ballast 70 or to the AC input.

Lamp(s) 2 may be incandescent, compact fluorescent, biax, linear fluorescent, HID, or other type lamp(s), depending on the lighting effects, illumination properties, power consumption, bulb life, ballast requirements, etc. for a particular installation. Lighting fixture 100 is modular and readily adaptable for modifying, such as by upgrading a ballast to a more efficient model or one with additional functionality, by changing lamp and/or ballast types, or by changing a lamp configuration within a lighting fixture. For example, a building manager may determine that a new walk way requires additional illumination. Rather than needing to replace an entire lighting fixture, the building manager may simply change a socket, ballast and/or lamp type to increase illumination on the new walkway. Similarly, for example, the building manager may decide to lower a light output of a lighting fixture, and may elect to change to a lower wattage bulb. The old lens frame, lens, baseplate, and lamp socket assembly may be used with appropriate new components. It may be desirable to install a new gasket when servicing or retrofitting a lighting fixture. Importantly, an AC line feed to the lighting fixture, and associated waterproof fittings to the fixture, may remain in place during servicing or retrofit.

A reflector 3 is placed over lamp socket mounting assembly 61 so that holes 33 line up with threaded holes 65 of lamp socket mounting assembly 61, and threaded fasteners 35 or the like are used for securing reflector 3 to lamp socket mounting assembly 61. In such a position, a reflector portion surrounding a window 34 of reflector 3 abuts and is parallel with a top surface of lamp socket mounting assembly 61, the window being approximately centered above aperture 68. In this manner, a small opening is provided to allow a lamp socket 72 to extend above reflector 3 while enclosing all electrical wires and connections in the space defined between baseplate 1 and reflector 3. The baseplate covering portion of reflector 3 has a flat middle portion 32 and beveled edges 31, 37. The lengthwise beveled edges 31 are further bent down to a position angularly ninety degrees with respect to the top surface 32, thereby providing two side surfaces 38 for reflector 3 as it sits atop baseplate 1 and lamp socket mounting assembly 61. The outer size of reflector 3 as defined by a distance between opposite side walls 38 is slightly smaller than an inner width defined as a distance between inner walls 84 of baseplate 1, so that a gasket 6 or similar sealing layer material disposed on flat surface 25 is not interfered with when reflector 3 is installed.

Reflector 3 is preferably formed of marine grade aluminum to provide a non-corroding reflecting surface that can withstand adverse environmental conditions. By effecting full use of reflection, approximately 92% reflectivity may be achieved. The reflector shape, including beveled edges 31, 37 and flat surface 32, allows the reflecting surface to be maximized, thereby maximizing efficiency, concealing internal components, and minimizing dark spots. The flat outward side 32 provides uniformity in illumination. As a result of such subtle design elements, reflector 3 assures that lighting fixture 100 operates, as a whole, to provide ultra-efficient and high quality lighting, resulting in very high levels of function and aesthetics.

Window 34 allows a lamp socket 72 to be positioned on the outward side of reflector 3 while all electrical connections, including ballast assembly 7, are located on the reflector inward side when reflector 3 is installed in lighting fixture 100. Lamps may be easily installed or replaced after lighting fixture 100 has been installed and the wiring covered. Baseplate 1, lamp support 61, and reflector 3 are preferably all painted with a high gloss white paint in order to maximize reflectivity.

Baseplate 1 may have several pairs of threaded mounting studs 16 for correspondingly mounting several ballast assemblies 7. The electrical output of ballasts 70 are fed to individual lampholder(s) of lamp socket mounting assembly 61 via wires or other conductors kept enclosed between reflector 3 and baseplate 1. Ballast assembly 7 and lamp socket mounting assembly 61 may be combined into a single module, for example, having conductors being fed between such components through a wire raceway portion (not shown).

Lens 4 in a preferred embodiment is formed of a high impact, high performance pearlescent, 100% DR acrylic material. Such material is ultraviolet (UV) stabilized, highly impact resistant, pressure-formed, non-yellowing and very strong, providing lamp protection and efficient light diffusion. For example, nominal and uniform thickness of approximately 0.125 inches provides a diffuser that is virtually unbreakable (other than by use of extreme force) when installed in the sconce-type lighting fixture 100. Lens 4 has a flanged outer perimeter portion 86 with a flat outer section 87 that includes a gasket face/footprint 45, and has a convex outer form.

FIGS. 10A–10E show different crossbar configurations for a "roof" type lens 49 and FIGS. 11A–11D show different crossbar configurations for a "dome" type lens 4. The two lenses 49, 4 are formed to have a same rectangular footprint of a flat mounting surface 45, a partial bottom view of which is illustrated in FIG. 8. The rectangular footprint 45 has a same basic shape as flat surface 25 of baseplate 1, so that a gasket 6 may be placed therebetween for sealing engagement of the surfaces. Dome type lens 4 has a cylindrical outward profile and lens 49 has an angular outward profile. Respective lengthwise end portions 42, 48 are slanted so that lighting fixture 10, 100 is free from any 'shelf' type surface. The optimum angle was achieved by experimentation with a soda can, whereby the slant angle causes such a can to slide off end portion 42, 48. As a result, a building manager is assured that lighting fixture 10, 100 does not become unsightly as a result of trash being placed on any surface of the fixture. Similarly, loitering will be discouraged because there is no surface on which a drink may be placed. In addition, when a lighting fixture 100 has two crossbars 5 near lengthwise end portions 48 of fixture 100, the lens 4 is preferably formed so that the outer end face 48 has its uppermost edge portion 57 proximate an outward edge 60 of the corresponding frame bar 5, as shown by example in FIG. 11B. Because of the proximity of edge 57 and outward edge 60, it becomes more difficult for a vandal, or other force, to break lens 4. Similarly, an uppermost point 59 of lens 49 is preferably close to an outer side of crossbar 50, as shown by example in FIG. 10C.

Gasket 6 has a rectangular shape corresponding to the shapes of surfaces 25 and 45 of baseplate 1 and lens 4, respectively. Gasket 6 may be formed of rubber, foam, adhesive, resins, silicone, and other materials, alone or in combination. Preferably, a surface of gasket 6 being mounted on surface 25 of baseplate 1 is secured to surface 25 with an adhesive, so that when service/maintenance (e.g., lamp replacement) is being performed, gasket 6 will not be affected.

One or more cross bars 5 are formed of heavy duty marine grade aluminum, for example having a quarter-inch thickness. In preferred embodiments, a shape of the crossbars 5 is the same as a shape of a corresponding lens 4, 49, thereby providing an equally attractive and tough enclosure. For example, crossbars 5 may be formed to provide an essentially uniform gap 24 between crossbars 5 and an outer surface of lens 4. Such a gap 24 may be, for example, approximately 1/32 to 3/16 of an inch. For the exemplary lenses 4, 49, corresponding crossbars 5, 50 respectively follow a 'dome' shape and a 'roof' shape.

Crossbar 5 is welded to lens frame 9 at a notch section 55 formed in a lengthwise beveled portion 58 of inner edge 92 of lens frame 9. The notch section 55 may also include a section of ridge 53 in order to provide access to the corresponding end 54 of crossbar 5 during the welding process. Weld 51 joins crossbar 5 to lens frame 9. Notch portions 55 are formed on sections of lens frame 9 opposing one another, so that crossbar 5 is positioned horizontally, or widthwise, when the lengthwise axis of lighting assembly 100 is vertical. A selected number of crossbars 5 may be welded in a similar manner to achieve a desired configuration. For example, FIGS. 11A–11D show various exemplary bar configurations for a sconce-type lighting fixture 100. A crossbar support/channel separator 82 is formed at an inner surface of frame portions 89, 91 near angled inner portion 92. A channel is thereby formed between separator 82 and angled inner portion 92, the channel being defined between respective intersecting points 28 and 29, as shown in the cross section of FIG. 7. Crossbar support 82 may be used for positioning crossbar 5 in preparation for creating weld 51.

Lens frame 9 may be formed using stock marine grade aluminum having a cross section as shown in FIG. 7. Pieces are cut to length from the stock with forty-five degree angles at the ends of the pieces. A corner bracket 56 is inserted into a bracket channel 80 of the cut pieces being joined together, so that four corner brackets 56 are used to form lens frame 9. Corner brackets 56 are preferably formed of stainless steel. Corner brackets 56 fit snugly into bracket channels 80, so that the just-assembled frame may be carried to a jig (not shown) for subsequent welding. When the assembled frame is installed in the welding jig, welds 52 are formed at each of the four corners of lens frame 9, the welds 52 are dressed and finished, burrs are removed, and then lens frame 9 is pre-treated and painted with high quality outdoor grade powder coating. A clear or other anodized finish such as satin, or a custom paint may alternatively be used.

Lenses 4, 49 have an inner knee 38 and an outer knee 39, each uniformly formed in a rectangle outwardly of the dome or roof shaped portions, respectively. Inner knee 38 is formed so that the dome or roof shaped portion of lens 4, 49 begins to project outwardly near beveled inner portion 92 of lens frame 9, and so that angled portion 86 of lens 4, 49 follows an interior shape of lens frame 9 when lens 4, 49 is installed. Outer knee 39 is formed so that flat portion 87 of lens 4, 49 is parallel to gasket surface 25 of baseplate 1 when lens 4, 49 is installed.

As shown in FIG. 8, tabs 44 are formed on the outward edge of lens 4. Tabs 44 allow lens 4 to be 'snap-fit' into lens frame 9. A flat exterior portion 87 is provided as a rectangular perimeter portion of lens 4 that rests on the flat portion 78 of lens channel 76 of lens frame 9 when lens 4 is being installed. An abutment location 77 of lens channel 76 limits the lateral position of tabs 44 during installation of one lengthwise side 20 of lens 4, whereupon slight compression of lens 4 allows installation of the tabs of opposite lengthwise side 90, such tabs 44 of opposite side 90 also resting on flat portion 78 of lens channel 76 of lens frame 9. Tabs 44 snap into lens channel 76 when a given tab 44 is pressed under nub 30, nub 30 being the innermost edge of angled inner surface 75 of lens frame 9. The lens frame channel defined between nub 30 and flat portion 78 thereby constitutes an inwardly-facing groove with uniform cross-section. That is, the cross-section of lens channel 76, including nub 30, abutment location 77 and flat surface 78 does not change as that cross-section moves around the circumference of lens frame 9. Lens 4 may be securely installed into an aluminum extrusion without accommodation. In other words, an inwardly-facing channel may be formed in lens frame 9, purely as an 'undercut.' Therefore, the same aluminum, (or other suitable material) extrusion may be used for manufacturing lens frames of various size, since all corresponding individual frame parts have the same "cross section." As discussed further below, a same lens frame 9 may be used for various different lens shapes, by simply substituting correspondingly different crossbars.

Reference character 74 denotes a beveled surface extending from baseplate mounting surface 75 to an outer end point 99. As shown in FIG. 7, a service channel is formed by the surface between edges 98 and 99, beveled surface 74, and the interior surface formed by inner shunt 97. Flat shunt faces 97, 95 face toward the rear of lighting fixture 100, with a curved shunt channel 96 formed therebetween.

When lighting fixture 100 is installed outdoors, for example by being affixed to a wall or other mounting surface, the fixture may be exposed to wet locations. Rain, sprinkler systems, power washers, and other sources may cause a lighting fixture to be subjected to water in varying amounts. In order to ensure that water does not enter any portion of lighting fixture 100 where electricity is present, gasket 6 or similar sealing system is used for providing a watertight seal between baseplate 1 and lens 4 as described above. In addition, the water shunt formed by surfaces 95, 96, 97 acts to divert water when lighting fixture 10, 100 is mounted to a surface. In particular, water is channeled vertically and/or horizontally by curved shunt channel 96, which extends circumferentially around the rearmost rear-facing side of lens frame 9.

When a large volume of water flows down a wall surface and contacts lighting fixture 100, shunt face 97, alone or in combination with shunt face 95 and curved shunt channel 96, acts to pass a portion of the water directly onto a rear surface 101 of baseplate 1, whereupon such water portion flows down baseplate 1 and off of lighting fixture 100. Instead of allowing the water of such a high-volume flow to fall into an interior portion of lighting fixture 100, the water shunt acts to break adhesion that would otherwise cause a water flow to follow along the interior-most portions of a fixture. For a water flow with a smaller volume, the curved shunt channel 96 tends to collect water by adhesion of droplets, and subsequent flow is diverted away from the interior of lens frame 9 by the water's adhesion to shunt channel 96. Water that trickles over an edge of shunt face 97 is additionally channeled away by rear portion 101 of baseplate 1 since shunt face 97 causes such trickle flow to fall directly onto surface 101 where such trickle subsequently falls away from lighting fixture 100, and by the service channel formed by edge 99 of lens frame 9. Further, rear portion 101 of baseplate 1 is at or near a rearmost location of lighting fixture 100 and thereby tends to provide a surface where any water not deflected by water shunt surfaces 95, 96, 97 (e.g., by adhesion of water to a mounting surface) flows down and off. Still further, an auxiliary channel for diverting water is formed by the intersection of flat flange portion 102 and wall 103 of baseplate 1. Such is effective to provide a path for any water not already diverted. Additionally, since such auxiliary channel is rearward of the cross section projection formed to include nub 30, it is practically impossible for any significant amount of water to reach nub 30. Even if such an unlikely event were to occur, gasket 6 assures that any such water would be prevented from violating the seal enclosing electrical portions of lighting fixture 100.

FIG. 12 is a bottom end view of an embodiment of a lighting fixture 200 having a deep surface housing 22 in place of, or in addition to, a lens frame 9. Deep surface housing 22 may be formed as a frame integral with lens frame 9 or as a separate extending portion 110 that is attachable to lens frame 9 as an adapter. In either case, extending portion 110 may have one or more conduit entries 23, such as a half-inch hole for accepting a standard size conduit fitting. By placing such a conduit entry 23 at a bottom of lighting fixture 200, water is kept away by the nature of relative shapes and locations of the various surfaces of lens frame 9, which act as a sort of 'umbrella' for protecting conduit entry 23.

FIGS. 13A and 13B respectively show a representative candlepower distribution and typical isofootcandle curves for a wall-sconce type lighting fixture according to an exemplary embodiment of the invention. For example, two 32 watt lamps may be used for producing approximately 2400 lumens per lamp. In such a case, the curves of FIG. 13B may be used for determining relative performance for different wall mounting heights by using an accompanying chart (not shown). Accordingly, a higher or lower illumination level may be chosen by selecting a lighting fixture size and/or lamp model for a particular application. In many installations, a wall sconce type lighting fixture is chosen to provide safety and aesthetics, rather than having a primary purpose of maximum illumination. Therefore, an architect may choose to select a sconce size and appearance that blends nicely with a building's overall design, while still assuring that walkways and doorways are illuminated with a necessary amount of light.

Lighting fixtures 10, 100 provide a scalable solution to any wall sconce lighting situation. In addition, the present inventors have determined optimum angles for maintaining a wall sconce type lighting fixture in a litter-free condition. Many installations will be in a public area where people are consuming soft drinks, food items, and the like. As a result, many people may choose to place a can, cup, or bottle on a surface as a sort of ersatz coffee table or drink holder. Rather than properly disposing of such cans, cups, and bottles, people may leave these drink items atop the chosen surface as litter. In order to prevent a wall sconce 10, 100 from becoming an unsightly litter receptacle, the present inventors experimented with the angle of end face 42 of lens 40 and end face 48 of lens 4 to assure that a soft drink can falls off such end face 42, 48. Therefore, end face 42, 48 is not able to be used as a drink holder and is not a collection point for litter. This assures that sconce type lighting fixture 10, 100 maintains a proper appearance.

Many variations of a sconce type lighting fixture may be obtained without changing molds, fixtures, and/or designs. Since lighting fixture 100 and its components are designed for modularity and scalability, manufacturing and associated inventory of parts and materials is simplified and less burdensome. Lens frame 9 has the same cross section for any size length and for each of its four sides. Widths of various components, such as lens 4 and crossbars 5, may be designed for standard widths, whereupon models having different lengths may have their respective components formed from a single design/shape.

Lighting fixture 100 is designed for serviceability while maintaining watertight sealing of the internal electrical items. Lens frame 9 and lens 4 may be removed as a unit by simply removing the four fasteners 94. Optionally, an interlock such as a limit switch (not shown) may be provided to disconnect electrical power when lens frame 9 is removed.

Preferably, all the structural lighting fixture elements are formed of marine grade aluminum, stainless steel, and other premium-quality non-corrosive materials. A material chosen for a lighting fixture component may be formed of other materials including, but not limited to various alloys, fiber, resin, composites, carbon-based materials, galvanized metal, and/or rubber. It is usually necessary and/or desirable for lighting fixture components to be conductive so, for example, backplate 1 may be used for providing a grounding surface to which all metal components may be electrically connected. For a given installation, such integral conductivity may be required in order to comply with applicable safety requirements specified for lighting fixtures by UL, the National Electric Code, and others.

Although the present invention has been described in conjunction with specific exemplary and non-limiting embodiments, it is to be understood that modifications and variations may be made without departing from the spirit and scope of the invention as understood by those skilled in the art. Such modifications and variations are considered to be within the purview and scope of the invention as defined by the appended claims.

What is claimed is:

1. A lighting fixture comprising:

a lens frame having a rearmost rear-facing side with an outer perimeter;

a baseplate connected to the lens frame; and a water shunt provided at the rearmost rear-facing side near the outer perimeter of the lens frame, the water shunt being structured for restricting water flow directed inwardly of the outer perimeter of the lens frame, wherein the water shunt includes at least two rear-facing surfaces extending around the outer perimeter of the lens frame, and wherein the lens frame has a circumferential beveled outer frame portion abutting an outermost one of the at least two rear-facing surfaces, and wherein a projection is defined as being a lens frame portion between an innermost one of the at least two rear-facing surfaces and an inner wall of the beveled outer frame portion.

2. The lighting fixture of claim 1 wherein the projection forms a drip point at a downwardly-extending edge thereof.

3. The lighting fixture of claim 2 wherein a circumferential first auxiliary channel is defined between the projection and a ridge portion abutting the inner wall of the beveled outer frame portion.

4. The lighting fixture of claim 3 wherein a circumferential second auxiliary channel is defined between the ridge portion abutting the inner wall of the beveled outer frame portion and the baseplate.

5. The lighting fixture of claim 4 wherein the baseplate has a center portion, a circumferential outer perimeter portion, and a wall between the center portion and the outer perimeter portion, the center portion being rearward of the outer perimeter portion, and wherein the circumferential second auxiliary channel is bounded by the wall.

6. The lighting fixture of claim 1 wherein the baseplate has a center portion, a circumferential outer perimeter portion, and a wall between the center portion and the outer perimeter portion, the center portion being rearward of the outer perimeter portion.

7. The lighting fixture of claim 6 wherein the center portion of the baseplate includes a plurality of mounting holes for securing the lighting fixture to a mounting surface.

8. The lighting fixture of claim 6 wherein the center portion of the baseplate includes a feed hole for passing electrical wires to an interior portion of the lighting fixture.

9. A lighting fixture having an external surface that includes a frontal light emitting side and a rear-facing baseplate surface of a baseplate, the lighting fixture comprising:

a lens frame connected to the baseplate and having an external rearmost rear-facing side adjacent the rear-facing baseplate surface, the lens frame having an outer perimeter; and a water shunt provided on the rearmost rear-facing side of the lens frame near the outer perimeter, the water shunt being structured for restricting external water flow directed inwardly of the outer perimeter of the lens frame.

10. The lighting fixture of claim 9 wherein the water shunt includes at least two rear-facing surfaces extending around at least part of the outer perimeter of the lens frame.

11. The lighting fixture of claim 10 wherein the water shunt includes a rear-facing curved channel disposed between the two rear-facing surfaces.

12. The lighting fixture of claim 10 wherein the lens frame has a circumferential beveled outer frame portion abutting an outermost one of the at least two rear-facing surfaces, and wherein a projection is defined as being a lens frame portion between an innermost one of the at least two rear-facing surfaces and an inner wall of the beveled outer frame portion.

13. The lighting fixture of claim 9 further comprising a lens adapted to be snapped into a secure position in the lens frame.

14. The lighting fixture of claim 13 further comprising a gasket for sealing the lens to the baseplate.

15. The lighting fixture of claim 9 wherein the lens frame includes at least one rigid frame bar attached widthwise across the frontal light emitting side.

16. The lighting fixture of claim 15 further comprising a lens having an extending portion, wherein the at least one rigid frame bar is shaped to protectively surround the extending portion of the lens.

17. The lighting fixture of claim 9 further comprising:

at least one lamp, the lamp being one of an incandescent, compact fluorescent, biax, linear fluorescent, and HID type; and a lamp socket for receiving the lamp.

18. A sconce comprising:

a lens frame having a vertically-oriented rearmost rear-facing external side with an outer perimeter and having a front side; and a water shunt provided on the rearmost rear-facing external side of the lens frame adjacent the outer perimeter, the water shunt being structured for restricting water flow directed inwardly of the outer perimeter of the lens frame.

19. The sconce of claim 18 wherein the water shunt includes at least two rear-facing surfaces extending around the outer perimeter of the lens frame.

20. The sconce of claim 19 wherein the rear-facing surfaces are essentially flat.

21. The sconce of claim 19 wherein the water shunt includes a rear-facing curved channel disposed between the two rear-facing surfaces.

22. The sconce of claim 18 wherein the lens frame includes at least one rigid frame bar disposed laterally across the front side of the lens frame.

23. The sconce of claim 22 further comprising a lens having an extending portion, wherein the at least one rigid frame bar is shaped to protectively surround the extending portion of the lens.

24. A method comprising providing a lighting fixture having an external surface that includes a frontal light emitting side and a vertically-oriented rear-facing baseplate surface of a baseplate, the providing of the lighting fixture including:

providing a lens frame connected to the baseplate and having an external vertically-oriented rearmost rear-facing side adjacent the rear-facing baseplate surface, the lens frame having an outer perimeter; and providing a water shunt on the rearmost rear-facing side of the lens frame near the outer perimeter, the water shunt being structured for restricting external water flow directed inwardly of the outer perimeter of the lens frame.

25. A lighting fixture comprising:

a lens frame having a rear-facing exterior portion and having an interior-facing portion;

a baseplate connected to the lens frame; and means disposed on the rear-facing exterior portion of the lens frame for shunting water away from the interior-facing portion.

26. The lighting fixture of claim 25 wherein the means for shunting water acts to interrupt a water flow caused by adhesion of water to an inner surface of the lens frame.

* * * * *